US006883429B2

(12) United States Patent
Kamoda

(10) Patent No.: US 6,883,429 B2
(45) Date of Patent: Apr. 26, 2005

(54) QUALITY INSPECTION APPARATUS FOR DOUBLE-SIDED PRINTING MACHINE

(75) Inventor: Hiroyoshi Kamoda, Chiba (JP)

(73) Assignee: Komori Corporation, Tokyo (JP)

( * ) Notice: Subject to any disclaimer, the term of this patent is extended or adjusted under 35 U.S.C. 154(b) by 178 days.

(21) Appl. No.: 09/826,831

(22) Filed: Apr. 6, 2001

(65) Prior Publication Data

US 2001/0027730 A1 Oct. 11, 2001

(30) Foreign Application Priority Data

Apr. 7, 2000 (JP) ..... 2000-106315

(51) Int. Cl.[7] ..... B41F 21/00; B41F 33/00

(52) U.S. Cl. ..... 101/480; 101/231; 101/246; 101/409

(58) Field of Search ..... 101/229, 230, 101/231, 246, 408, 409, 480

(56) References Cited

U.S. PATENT DOCUMENTS

| | | | | | |
|---|---|---|---|---|---|
| 3,759,177 | A | * | 9/1973 | Gazzola et al. | 101/232 |
| 4,210,078 | A | * | 7/1980 | Greiner et al. | 101/136 |
| 4,448,121 | A | | 5/1984 | Uno et al. | |
| 4,794,856 | A | * | 1/1989 | Giori | 101/152 |
| 5,471,309 | A | | 11/1995 | Bolza-Schunemann | |
| 5,724,437 | A | * | 3/1998 | Bucher et al. | 382/112 |
| 5,974,683 | A | * | 11/1999 | Shibata | 34/88 |
| 6,036,187 | A | * | 3/2000 | Schaede | 271/204 |
| 6,192,140 | B1 | | 2/2001 | Reinhard et al. | |
| 6,332,398 | B1 | * | 12/2001 | Reinhard et al. | 101/234 |
| 6,508,172 | B1 | * | 1/2003 | Kusaka | 101/483 |

FOREIGN PATENT DOCUMENTS

| | | | |
|---|---|---|---|
| DE | 19624196 | A | 1/1998 |
| EP | 0576824 | A | 1/1994 |
| FR | 2507541 | A | 12/1982 |
| JP | 01316268 | A * | 12/1989 |

* cited by examiner

*Primary Examiner*—Andrew H. Hirshfeld
*Assistant Examiner*—Jill E. Culler
(74) *Attorney, Agent, or Firm*—Birch, Stewart, Kolasch & Birch, LLP

(57) ABSTRACT

A quality inspection apparatus for a double-sided printing machine which includes a rubber impression cylinder and a rubber cylinder; inking unite for supplying ink to the rubber impression cylinder and the rubber cylinder; and a transport mechanism for transporting the printed paper to a delivery unit. The transport mechanism includes first through third transport cylinders for transporting the paper from the first delivery chain, and a delivery chain for transporting the paper from the first through third transport cylinders. The quality inspection apparatus includes an inspection camera for detecting a status of printing on one face of the paper when transported by the first transport cylinder, and an inspection camera for detecting a status of printing on the other face of the paper when transported by the second transport cylinder.

12 Claims, 7 Drawing Sheets

QUALITY INSPECTION APPARATUS FOR DOUBLE-SIDED PRINTING MACHINE

The entire disclosure of Japanese Patent Application No. 2000-106315 filed on Apr. 7, 2000 including specification, claims, drawings and summary is incorporated herein by reference in its entirety.

BACKGROUND OF THE INVENTION

1. Field of the Invention

The present invention relates to a quality inspection apparatus for a double-sided printing machine capable of printing opposite faces of a sheet-like material, and, more particularly, to a quality inspection apparatus for a double-sided printing machine which enables double-sided quality inspection without necessity of increasing installation space.

2. Description of the Related Art

An example of a conventional double-sided printing machine is a four-color double-sided simultaneous offset printing press as shown in FIG. 7 (see Japanese Patent No. 2612594).

In a printing unit 100 of the main unit, a rubber impression cylinder 101 having a paper gripping apparatus and a rubber cylinder 102 having no paper gripping apparatus are supported substantially horizontally such that the circumferential surfaces of the cylinders 101 and 102 are in contact with each other.

Four plate cylinders 103 are disposed along the circumferential surface of the rubber impression cylinder 101; and four plate cylinders 104 are disposed along the circumferential surface of the rubber cylinder 102. Inking units 105 and 106 are movably disposed such that the inking units 105 and 106 can approach and separate from the plate cylinders 103 and 104, respectively. The inking units 105 and 106 can supply ink and water to the plate cylinders 103 and 104 in a state in which the inking units 105 and 106 are in contact with the plate cylinders 103 and 104.

Meanwhile, a delivery cylinder 108 of a delivery unit 107 is disposed below the rubber impression cylinder 101. A chain 109 is disposed on the left Bide of the delivery cylinder 108 as shown in FIG. 7, such that the chain 109 does not cross a space below the position at which the circumferential surface of the rubber impression cylinder 101 is in contact with that of the rubber cylinder 102.

Further, transfer cylinders 111 to 114 each having a paper gripping apparatus are provided in order to transfer paper from a register 110 to the rubber impression cylinder 101; and a transfer cylinder 115 having a paper gripping apparatus is provided in order to transfer paper from the rubber impression cylinder 101 to the delivery cylinder 108. In FIG. 7, reference numeral 116 denotes a feeder unit.

Accordingly, a sheet of paper fed from the feeder unit 116 and positioned by the register 110 is conveyed along a path indicated by arrows in FIG. 7; i.e., is conveyed along the circumferential surfaces of the transfer cylinders 111 to 114, the circumferential surface of the rubber impression cylinder 101, the circumferential surface of the transfer cylinder 115, and the circumferential surface of the delivery cylinder 108, in this sequence. When the sheet of paper passes through the contact point between the rubber impression cylinder 101 and the rubber cylinder 102 from the upper side to the lower side of the contact point, the opposite faces of the sheet of paper undergo printing simultaneously.

Incidentally, when bank notes are printed by use of the above-described four-color double-sided simultaneous offset printing press, quality control is of particular importance. Therefore, conventionally, bank notes have been inspected manually by a large number of workers in an off-line fashion.

Recently, in order to save labor needed for inspection, there has been a trend toward performing in-line inspect printing, by use of an image technique, for each of printing steps, such as an offset printing step, an intaglio printing step, and a numbering step, to thereby prevent poorly-printed paper from being fed to a subsequent step.

Presently, such an in-line printing-quality inspection apparatus is employed in intaglio printing presses, but is not employed in four-color double-sided simultaneous offset printing presses, in consideration of installation space.

For example, when double-sided quality inspection is to be performed after completion of double-sided printing but before paper delivery, a suction guide and an inspection camera must be disposed on each of the opposite sides of a paper delivery chain; i.e., two sets consisting of the suction guide and the inspection camera (one for the front face of paper, and one for the back face of paper) must be provided. In such as case, since the suction guide cannot be disposed on the gripper-bar side of the paper delivery chain (because of interference with gripper bars), one of the set for the front face and the set for the back face must be disposed while the paper delivery chain is inverted. This increases the length of the transport path, resulting in an increase in the size of the apparatus.

SUMMARY OF THE INVENTION

In view of the foregoing, an object of the present invention is to provide a quality inspection apparatus for a double-sided printing machine, which apparatus enables performance of in-line double-sided quality inspection after completion of double-sided printing but before paper delivery, without increasing installation space and overall machine length.

To achieve the above object, the present invention provides a quality inspection apparatus for a double-sided printing machine which comprises a printing unit for printing opposite faces of a sheet-like material; ink supply means for supplying ink to the printing unit, the ink supply means being supported to be brought into contact with and separated from the printing unit; and transport means for transporting the sheet-like material to a delivery unit while holding the sheet-like material. The transport means is constructed by means of a first delivery chain passing through a lower side of the ink supply means, a plurality of transport cylinders for transporting the sheet-like material from the first delivery chain, and a second delivery chain for transporting the sheet-like material from the plurality of transport cylinders. The plurality of transport cylinders include at least first and second transport cylinders. The quality inspection means includes first detection means for detecting a status of printing on one face of the sheet-like material when the material is transported by the first transport cylinder, and second detection means for detecting a status of printing on the other face of the sheet-like material when the material is transported by the second transport cylinder. Therefore, the quality inspection apparatus of the present invention can perform in-line double-sided quality inspection after completion of double-sided printing but before paper delivery, without increasing installation space and overall machine length.

DESCRIPTION OF THE PREFERRED EMBODIMENTS

A quality inspection apparatus for a double-sided printing machine according to the present invention will next be described by way of embodiments and with reference to the drawings.

First Embodiment

Figure 1:
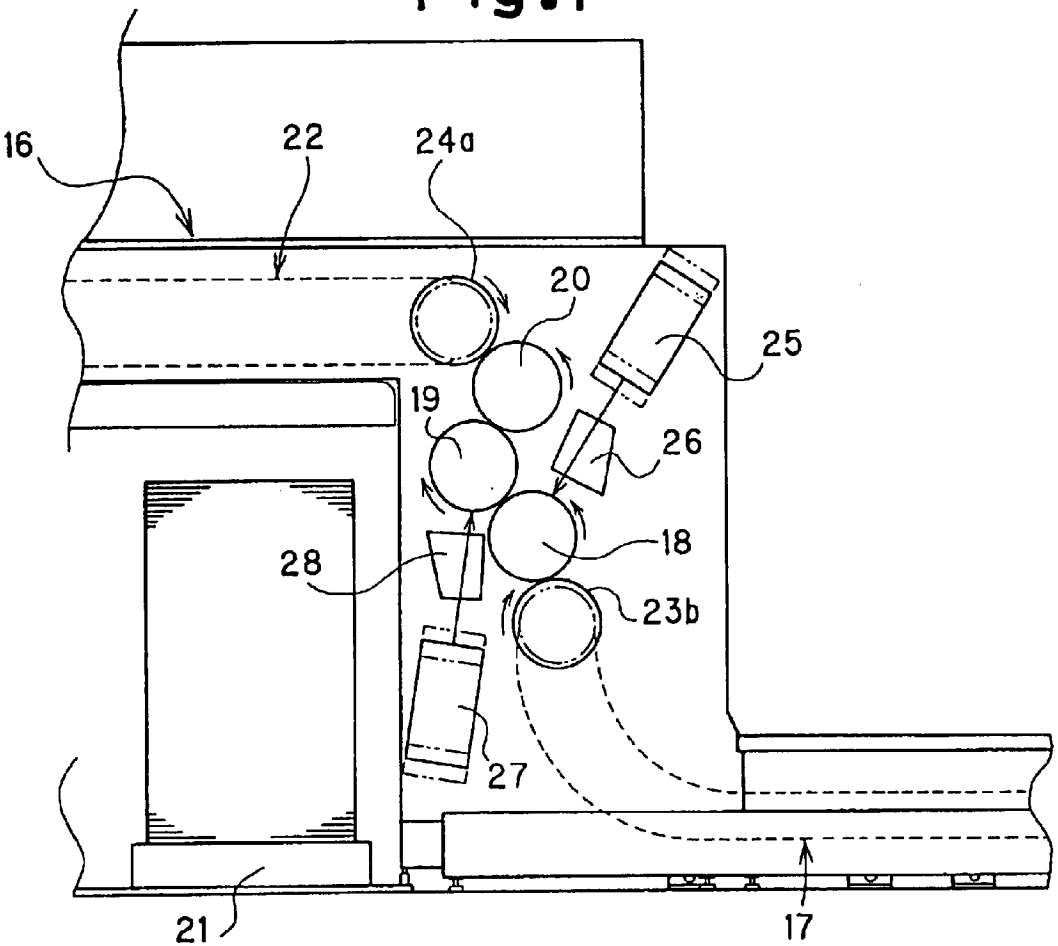
FIG. 1 is an enlarged side view of a main portion of a four-color double-sided simultaneous offset printing press according to the first embodiment of the present invention.
Figure 2:
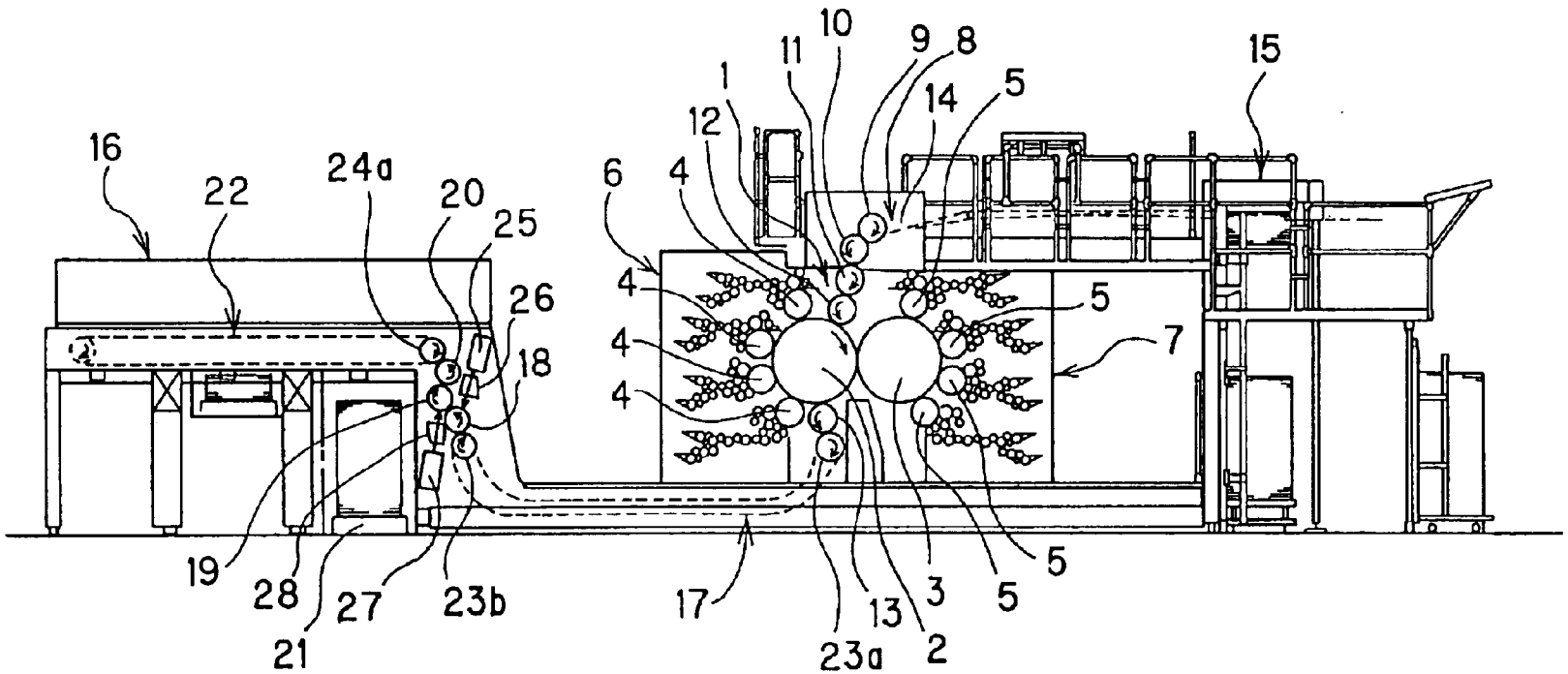
FIG. 2 is an overall side view of the offset printing press.
Figure 3:
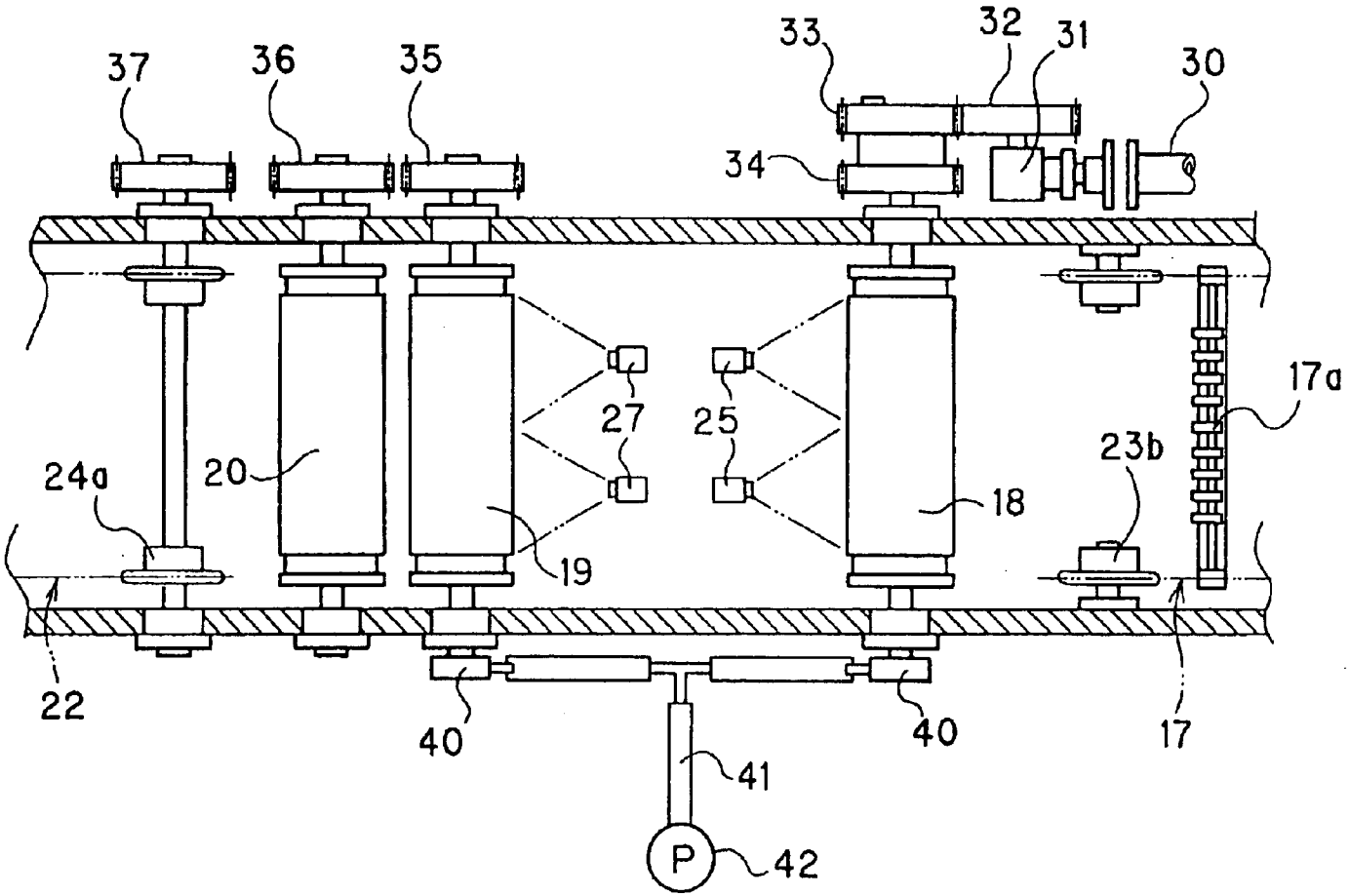
FIG. 3 is a development plan view showing a drive system of the main portion of the offset printing press.
Figure 4:
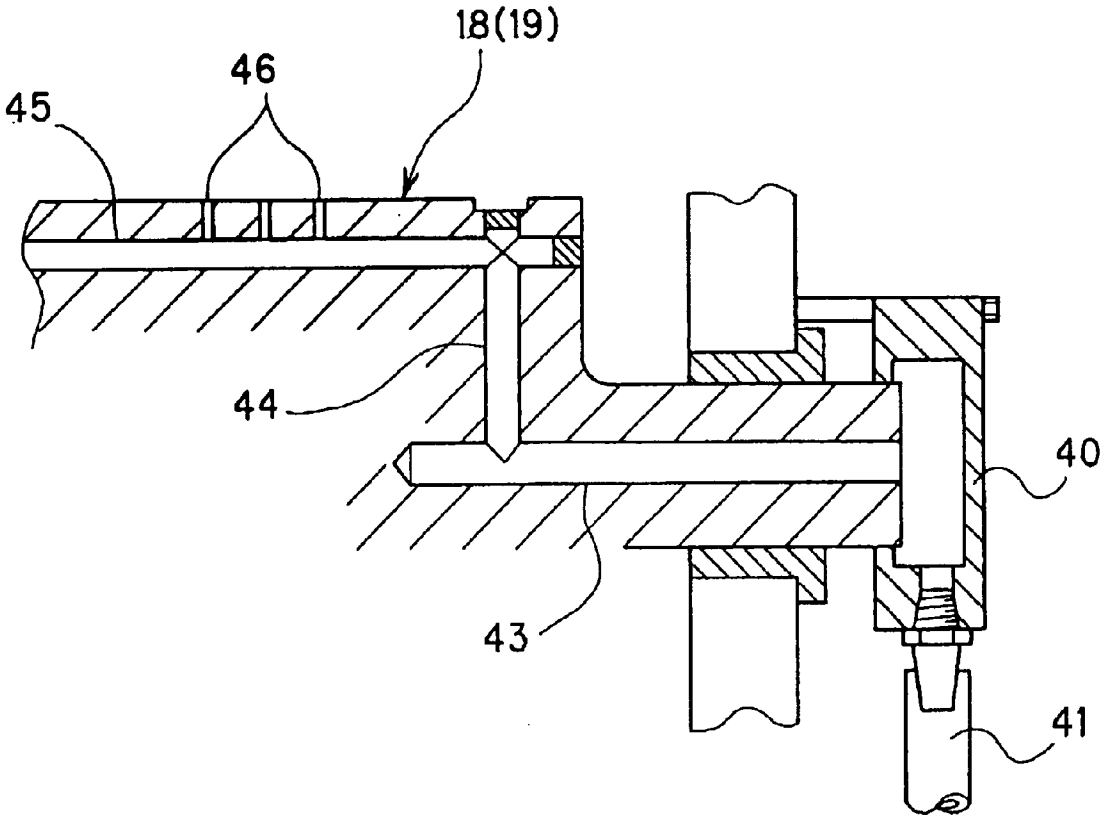
FIG. 4 is a front sectional view of a main portion of a suction cylinder.
Figure 5:
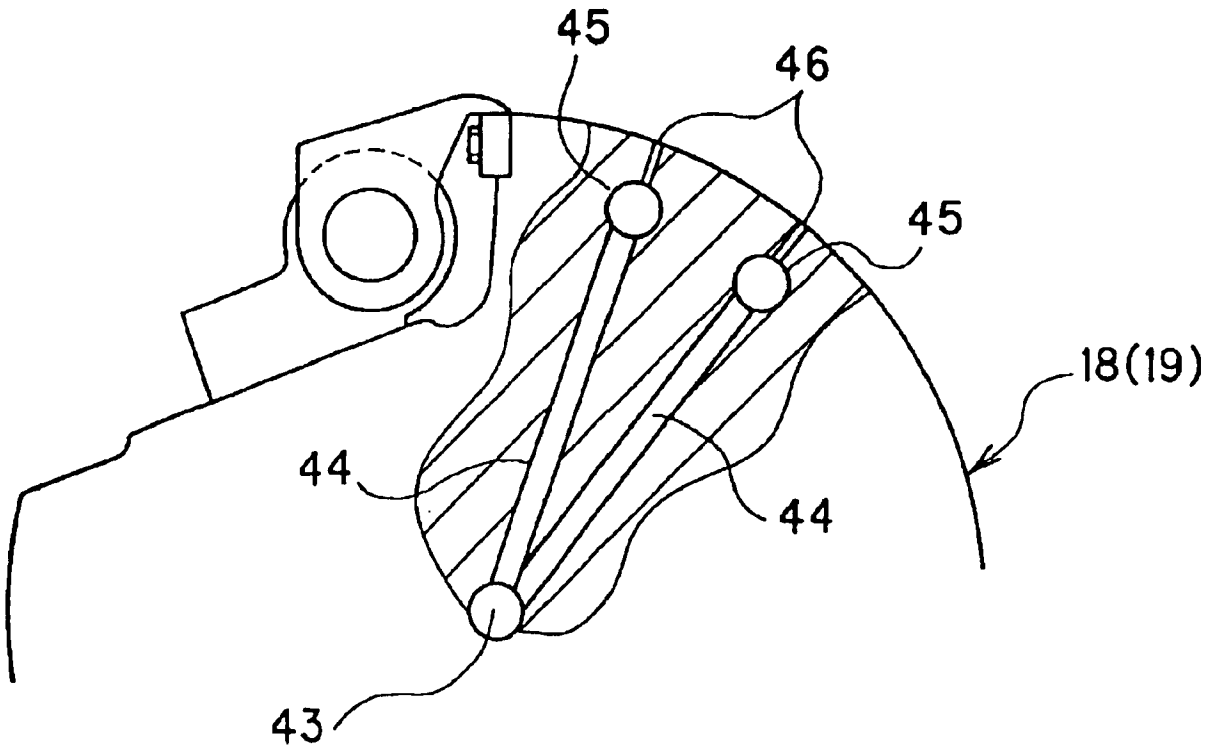
FIG. 5 is a side sectional view of the main portion of the suction cylinder.

FIG. 1 is an enlarged side view of a main portion of a four-color double-sided simultaneous offset printing press according to the first embodiment of the present invention; FIG. 2 is an overall side view of the offset printing press; FIG. 3 is a development plan view showing a drive system of the main portion of the offset printing press; FIG. 4 is a front sectional view of a main portion of a suction cylinder; and FIG. 5 is a side sectional view of the main portion of the suction cylinder.

As shown in FIGS. 1 and 2, in a printing unit 1 of a four-color double-sided simultaneous offset printing press, a rubber impression cylinder 2 having a paper gripping apparatus and a rubber cylinder 3 having no paper gripping apparatus are supported substantially horizontally such that the circumferential surfaces of the cylinders 2 and 3 are in contact with each other.

Four plate cylinders 4 are disposed along the circumferential surface of the rubber impression cylinder 2; and four plate cylinders 5 are disposed along the circumferential surface of the rubber cylinder 3. Inking units 6 and 7 serving as ink supply means are movably disposed such that the inking units 6 and 7 can approach and separate from the plate cylinders 4 and 5, respectively. The inking units 6 and 7 can supply ink and water to the plate cylinders 4 and 5 in a state in which the inking units 6 and 7 are in contact with the plate cylinders 4 and 5. The rubber impression cylinder 2, the plate cylinders 4, the rubber cylinder 3, and the plate cylinders 5 correspond to the printing unit described in claim 1.

Further, transfer cylinders 9 to 12 each having a paper gripping apparatus are provided in order to transfer paper (sheet-like material) from a register 8 to the rubber impression cylinder 2; and a transfer cylinder 13 having a paper gripping apparatus is provided in order to transfer paper from the rubber impression cylinder 2 to a first delivery chain 17, which will be described later. The paper is supplied from a feeder unit 15 to the register 8 via a feeder board 14.

Transport means for transporting paper to a delivery unit 16 includes the first delivery chain 17 equipped with a gripper bar (chain gripper) 17*a* (see FIG. 3) and adapted to receive paper from the transfer cylinder 13 and transport it; first through third transfer cylinders (transport cylinders) 18 to 20 each having paper gripping apparatus and adapted to receive paper from the first delivery chain 17 and transport it; and a second delivery chain 22 equipped with a gripper bar (not shown) and adapted to receive paper from the first through third transfer cylinders 18 to 20 and transport it onto a delivery pile 21.

An upstream-side delivery cylinder 23*a* of the first delivery chain 17 is disposed below the rubber impression cylinder 2; and the first delivery chain 17 extends along the floor to the left from the delivery cylinder 23*a* in FIG. 2, without crossing a space below the position of contact between the circumferential surface of the rubber impression cylinder 2 and that of the rubber cylinder 3.

The first through third transfer cylinders 18 to 20 are disposed between a downstream-side delivery cylinder 23*b* of the first delivery chain 17 and an upstream-side delivery cylinder 24*a* of the second delivery chain 22 and are arranged in zigzag fashion along the vertical direction. That is, the second transfer cylinder 19 projects leftward with respect to the first transfer cylinder 18 and the third transfer cylinder 20.

An inspection camera 25 is disposed to face downward together with a spotlight 26. The inspection camera 25 serves as the first detection means for detecting the status of printing on one face (front face) of paper transported by the first transfer cylinder 18. Similarly, an inspection camera 27 is disposed to face upward together with a spotlight 28. The inspection camera 27 serves as the second detection means for detecting a status of printing on the other face (back face) of paper transported by the second transfer cylinder 19. The inspection cameras 25 and 27 and the spotlights 26 and 28 are provided at each of two locations along the cylinder axis (see FIG. 3).

The first through third transfer cylinders 18 to 20 are driven by a drive system as shown in FIG. 3. Drive force is transmitted from the main unit to a line shaft 30. The drive force is transmitted from the line shaft 30 to a spur gear 32 via a bevel box 31 in order to rotate the spur gear 32.

Subsequently, a spur gear 33 in meshing engagement with the spur gear 32 is driven. The spur gear 33 is connected to a drive spur gear 34 of the first transfer cylinder 18 by means of bolts; and phase matching with the first transfer cylinder 18 is established on the basis of the timing at which the gripper bar 17*a* of the first delivery chain 17 reaches a predetermined position.

Rotation of the drive spur gear 34 is successively transmitted, by means of meshing engagement, to a driven spur gear 35 of the second transfer cylinder 19, a driven spur gear 36 of the third transfer cylinder 20, and a driven spur gear 37 of the delivery cylinder 24*a*, whereby the individual cylinders are driven, and the second delivery chain 22 is driven. The first delivery chain 17 is driven by the upstream-side delivery cylinder 23*a*, which has a driven spur gear (not shown) in meshing engagement with the drive gear train of the main unit.

As shown in FIGS. 4 and 5, each of the first transfer cylinder 18 and the second transfer cylinder 19 is a suction cylinder. One end of a pipe 41 is connected to the axial end of the cylinder via a rotary joint 40, and the other end of the pipe 41 is connected to a vacuum pump 42. In FIGS. 4 and 5, reference numeral 43 denotes a main-negative-pressure passage formed within the axial end of each of the first transfer cylinder 18 and the second transfer cylinder 19; 44 denotes a plurality of sub-negative-pressure passages branched from the main-negative-pressure passage 43 at different circumferential positions and extending radially; 45 denotes negative-pressure manifolds extending from the tip ends of the sub-negative-pressure passages 44 in the cylinder axis direction; and 46 denotes a large number of suction holes branched from each of the negative-pressure manifolds 45 at different axial positions and opened to the cylinder surface.

Since the printing press of the present embodiment is configured as described above, a sheet of paper fed from the feeder unit 15 and positioned by the register 8 is transported along a path indicated by arrows in FIG. 2; i.e., is transported along the circumferential surfaces of the transfer cylinders 9 to 12, the circumferential surface of the rubber impression cylinder 2, the circumferential surface of the transfer cylinder 13, and the circumferential surface of the delivery cylinder 23*a*, in this sequence. When the sheet of paper passes through the contact point between the rubber impression cylinder 2 and the rubber cylinder 3 from the upper side to the lower side of the contact point, the opposite faces of the sheet of paper undergo printing simultaneously.

The printed sheet of paper is transported along a path indicated by arrows in FIG. 1 from the first delivery chain 17 to the first through third transfer cylinders 18 to 20, then to the second delivery chain 22, and is finally stacked on the delivery pile 21 of the delivery unit 16.

In the present embodiment, when the sheet of paper is transported by the first transfer cylinder 18, the status of printing on the front face is detected by the inspection camera 25. Similarly, when the sheet of paper is transported by the second transfer cylinder 19, the status of printing on the back face is detected by the inspection camera 27.

Since each of the first transfer cylinder 18 and the second transfer cylinder 19 consists of a suction cylinder, the sheet of paper is transported in a stable state in which the sheet of paper is sucked by and fixed to the circumferential surface of the cylinder (the paper does not flutter). Therefore, precise inspection can be performed.

As described above, in the present embodiment, a portion of the delivery chain is replaced of a group of transfer cylinders, and inspection cameras 25 and 27 are disposed. Therefore, in-line double-sided quality inspection can be performed after completion of double-sided printing but before paper delivery, without increasing installation space and overall machine length.

In the present embodiment, since employment of suction cylinders as the first transfer cylinder 18 and the second transfer cylinder 19 eliminates necessity of suction guides or like parts, attachment of the inspection cameras 25 and 27 is facilitated, and increased installation space can be secured.

In the present embodiment, since the first through third transfer cylinders 18 to 20 are arranged in zigzag fashion along the vertical direction, attachment of the inspection cameras 25 and 27 (and the spotlights 26 and 28) is facilitated, and increased installation space can be secured.

Second Embodiment

Figure 6:
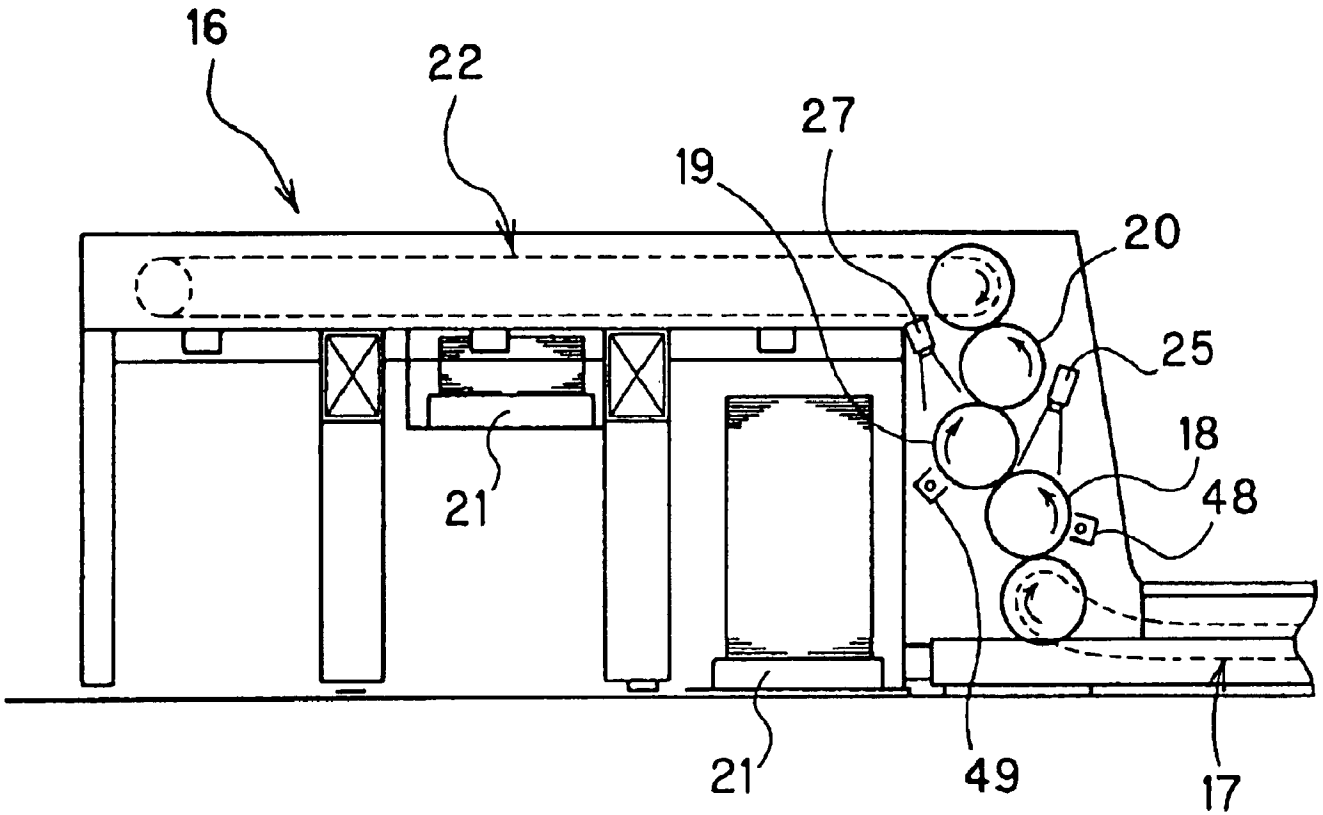
FIG. 6 is a side view of a main portion of a four-color double-sided simultaneous offset printing press according to the second embodiment of the present invention.
Figure 7:
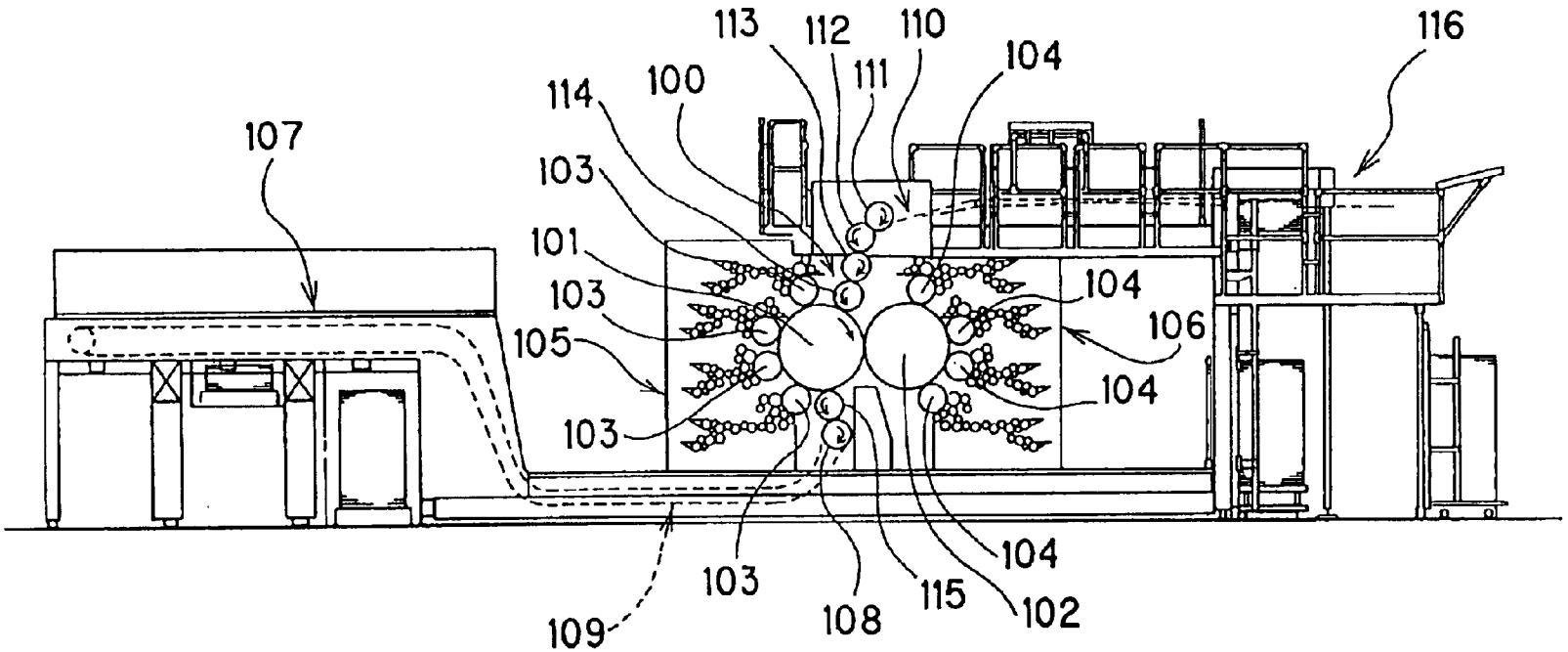
Fig. 7 Related Art
FIG. 7 is an overall side view of a conventional four-color double-sided simultaneous offset printing press.

FIG. 6 is a side view of a main portion of a four-color double-sided simultaneous offset printing press according to a second embodiment of the present invention.

In the present embodiment, dryers 48 and 49 are disposed to face the first transfer cylinder 18 and the second transfer cylinder 19, respectively, used in the first embodiment such that the dryer 48 is located on the upstream side of the inspection camera 25, and the dryer 49 is located on the upstream side of the inspection camera 27. Thus, smears due to double-sided printing are prevented.

The structure of the second embodiment is the same as that of the first embodiment, except that the inspection camera 27 is disposed to face downward, and the spotlights 26 and 28 are eliminated. Therefore, the second embodiment achieves the same action and effects as those achieved by the first embodiment.

The present invention is not limited to the above-described embodiments, and may be modified in various manners without departing from the scope of the present invention. For example, the first through third transfer cylinders 18 to 20 may arranged along a straight line. The third transfer cylinder 20 may be eliminated, or other transfer cylinders may be added.

What is claimed is:

1. A double-sided printing machine, comprising:

a printing unit for printing opposite faces of a sheet-like material;

ink supply means for supplying ink to said printing unit, said ink supply means being supported to be brought into contact with and separated from said printing unit;

a delivery pile, provided downstream of the printing unit, for collecting said sheet-like material; and transport means for transporting said sheet-like material from said printing unit to said delivery pile while holding said sheet-like material, said transport means including, a first delivery chain passing through a lower side of said ink supply means, a second delivery chain provided above the delivery pile, wherein the second delivery chain is located in relatively close proximity to a site directly above the delivery pile and extending in a straight line along its entire length and being parallel to a floor surface on which the printing machine is installed, a plurality of transport cylinders for transporting said sheet-like material from said first delivery chain to said second delivery chain and provided at a position higher than the first delivery chain and lower than the second delivery chain, said plurality of transport cylinders including a first transport cylinder and a second transport cylinder provided immediately adjacent to the delivery pile and arranged in zigzag fashion with respect to a generally vertical directions, wherein the first transport cylinder and the second transport cylinder are located below a position where the sheet-like material transported by the second delivery chain is released from the second delivery chain and delivered to the delivery pile, first detection means for detecting a status of printing on one face of said sheet-like material when said sheet-like material is transported by said first transport cylinder; and second detection means for detecting a status of printing on the other face of said sheet-like material when said sheet-like material is transported by said second transport cylinder.

2. A double-sided printing machine according to claim 1, wherein each of said first and second transport cylinders is a suction cylinder.

3. A double-sided printing machine according to claim 1, further comprising:

first drying means provided on the upstream side, with respect to the transport direction, of a detection position at which said first detection means detects said sheet-like material held by said first transport cylinder; and second drying means provided on the upstream side, with respect to the transport direction, of a detection position at which said second detection means detects said sheet-like material held by said second transport cylinder.

4. A double-sided printing machine according to claim 3, wherein said first drying means is disposed to face said first transport cylinder, and said second drying means is disposed to face said second transport cylinder.

5. A double-sided printing machine according to claim 1, wherein said plurality of transport cylinders include a third transport cylinder and wherein the first, second and third transport cylinders are located between an upstream-side delivery cylinder and a downstream-side delivery cylinder, with the first transport cylinder being in contact with the upstream-side delivery cylinder and the third transport cylinder being in contact with the downstream-side delivery cylinder, and with the second cylinder being located between and in offset contact with the first and third transfer cylinders.

6. A quality inspection apparatus for a double-sided printing machine having a printing unit and a delivery pile provided downstream of the printing unit, comprising:

transport means, provided between the printing unit and the delivery pile, for transporting a sheet-like material from the printing unit to the delivery pile, said transport means including, a first delivery chain passing through a lower side of said printing unit, a second delivery chain provided above the delivery pile, wherein the second delivery chain is located in relatively close proximity to a site directly above the delivery pile and extends in a straight line along its entire length so as to be parallel to a floor surface on which the printing machine is installed; and a first transport cylinder and a second transport cylinder provided at a position higher than the first delivery chain and lower than the second delivery chain and adapted to transport the sheet-like material from the first delivery chain to the second delivery chain, wherein the first transport cylinder and the second transport cylinder are located below a position where the sheet-like material transported by the second delivery chain is then released from the second delivery chain and delivered to the delivery pile, the first transport cylinder and the second transport cylinder being arranged in zigzag fashion with respect to a generally vertical direction, and wherein a first space is formed above the first transport cylinder, and a second space is formed below the second transport cylinder;

first detection means, provided in the first space, for detecting a status of printing on one face of said sheet-like material when said sheet-like material is transported by said first transport cylinder; and second detection means, provided in the second space, for detecting a status of printing on the other face of said sheet-like material when said sheet-like material is transported by said second transport cylinder.

7. The quality inspection apparatus according to claim 6, wherein at least one of said first and second transport cylinders is a suction cylinder.

8. The quality inspection apparatus, according to claim 6, wherein said first detection means includes a first spot light provided inside the first space and said second detection means includes a second spot light provided inside the second space.

9. The quality inspection apparatus, according to claim 6, further comprising:

first drying means provided in the first space for drying said sheet-like material while being held by said first transport cylinder; and second drying means provided in the second space for drying said sheet-like material while being held by said second transport cylinder.

10. A double-sided printing machine according to claim 6, wherein said plurality of transport cylinders include a third transport cylinder and wherein the first, second and third transport cylinders are located between an upstream-side delivery cylinder and a downstream-side delivery cylinder, with the first transport cylinder being in contact with the upstream-side delivery cylinder and the third transport cylinder being in contact with the downstream-side delivery cylinder, and with the second cylinder being located between and in offset contact with the first and third transfer cylinders.

11. A double-sided printing machine, comprising:

a printing unit for printing opposite faces of a sheet-like material;

ink supply means for supplying ink to said printing unit, said ink supply means being supported to be brought into contact with and separated from said printing unit;

a delivery pile provided downstream of the printing unit;

transport means for transporting said sheet-like material from said printing unit to the delivery pile while holding said sheet-like material, said transport means including, a first delivery chain passing through a lower side of said ink supply means, a second delivery chain provided above the delivery pile, wherein the second delivery chain is located in relatively close proximity to a site directly above the delivery pile and extends in a straight line along its entire length so as to be parallel to a floor surface on which the printing machine is installed; and a plurality of transport cylinders, arranged in a zigzag fashion, provided at a position higher than the first delivery chain and lower than the second delivery chain, for transporting said sheet-like material from said first delivery chain to said second delivery chain, said plurality of transport cylinders including at least a first transport cylinder and a second transport cylinder, and;

wherein the first transport cylinder and the second transport cylinder are located below a position where the sheet-like material transported by the second delivery chain is then released from the second delivery chain and delivered to the delivery pile, first detection means for detecting a status of printing on one face of said sheet-like material when said sheet-like material is transported by said first transport cylinder; and second detection means for detecting a status of printing on the other face of said sheet-like material when said sheet-like material is transported by said second transport cylinder;

first drying means provided on the upstream side, with respect to the transport direction, of a detection position at which said first detection means detects said sheet-like material held by said first transport cylinder; and second drying means provided on the upstream side, with respect to the transport direction, of a detection position at which said second detection means detects said sheet-like material held by said second transport cylinder.

12. A double-sided printing machine according to claim 11, wherein said plurality of transport cylinders include a third transport cylinder wherein the first, second and third transport cylinders are located between an upstream-side delivery cylinder and a downstream-side delivery cylinder, with the first transport cylinder being in contact with the upstream-side delivery cylinder and the third transport cylinder being in contact with the downstream-side delivery cylinder, and with the second cylinder being located between and in offset contact with the first and third transfer cylinders.

* * * * *